United States Patent [19]

Kitai et al.

[11] 4,295,215

[45] Oct. 13, 1981

[54] SECOND HAND CORRECTION DEVICE FOR USE IN TIMEPIECES

[75] Inventors: Kiyoshi Kitai; Masuo Ogihara; Kozo Chimura, all of Shikawatashi, Japan

[73] Assignee: Seiko Koki Kabushiki Kaisha, Tokyo, Japan

[21] Appl. No.: 15,624

[22] Filed: Feb. 27, 1979

[30] Foreign Application Priority Data

Mar. 1, 1978 [JP] Japan ..... 53/23898

[51] Int. Cl.[3] ..... G04B 27/02; G04B 17/12; G04B 27/00

[52] U.S. Cl. ..... 368/196; 368/185; 368/190

[58] Field of Search ..... 58/34, 85.5; 368/185, 368/190, 112, 196

[56] References Cited

U.S. PATENT DOCUMENTS 3,744,234 7/1973 Kamijo ..... 58/34
4,050,234 9/1977 Toshio ..... 58/85.5
4,051,666 10/1977 Yoshino et al. ..... 58/85.5

FOREIGN PATENT DOCUMENTS 564222 7/1975 Switzerland ..... 58/85.5

*Primary Examiner*—J. V. Truhe
*Assistant Examiner*—John B. Conklin
*Attorney, Agent, or Firm*—Robert E. Burns; Emmanuel J. Lobato; Bruce L. Adams

[57] ABSTRACT

A second hand correction device comprising a second hand correction member which may be moved manually in inward and outward directions and in forward rotation and reverse rotation directions and a cam wheel, having a plurality of cams, which is fixed to the second hand axis. The second hand correction member is moved in such a direction as biased under an engagement with the cam wheel when the same is lowered, and engages with the cam at the rear half of its stroke. Subsequent lowering operation of the second hand correction member will cause the rotation of the cam wheel and thereby the second hand will be rotated by a specified angle to enable a repetitive continuous correction for the second hand.

7 Claims, 5 Drawing Figures

SECOND HAND CORRECTION DEVICE FOR USE IN TIMEPIECES

BACKGROUND OF THE INVENTION

This invention relates to a second hand correction device for use in a three-hand timepiece and more particularly a second hand correction device in which the second hand is advanced up to a specified scale and then stopped.

In a conventional type of timepiece having a motor therein, there have been provided devices, as for example a switch operated by the slide button etc., to stop the above mentioned motor electrically and then to stop the second hand. Another method of stopping the motor is to have one end of the slide button press against the rotor etc. to stop the second hand mechanically. However, in such conventional techniques, only a second hand is stopped and thus if it is required to correct some errors such as delay in several seconds, it is required to operate the button at first and then to stop the second hand at a position of a second scale which may be set in reference to a correct time indication and at the same time a minute hand is advanced by one minute or two minutes and thereafter the slide button is returned to the starting position in reference to the correct time indication after passing of the advanced time. Finally the second hand should or must be advanced or started, these operations make the operation or use of such techniques complicated. Thus in order to overcome disadvantages, there has been proposed such a method such that when the slide button is operated, the button acts against a cam wheel installed in the second hand gear, and displaces it to the next ten second scale position and stops it. However, even in this method, when the time to be corrected is some seconds or several seconds, this method fulfills the requirement and to the contrary when it is required to correct the delay more than ten seconds, the second hand is once advanced by operating the button and then operating the button immediately after the previous operation, the second hand correction member may not push the cam wheel due to the fact that a phase of the cam wheel of the second hand wheel is not varied even if the second hand correction member is lowered. Thus in order to perform the next button operation, it is necessary to wait one to two seconds. When there are many times of operation of the button, it is needed to have one to two seconds waiting time and thus there is no sufficient system to fulfill the requirement.

SUMMARY OF THE INVENTION

In view of these defects, it is an object of the present invention to provide a device such that the second hand position may easily be corrected. In accordance with the present invention, the above described object is accomplished by arranging a cam wheel having a plurality of cams on the second hand axis, a second hand correction member which may be operated manually to act on said cam wheel and displaced by a specified amount for moving the second hand and further by arranging a control means for controlling an orbit of reciprocating movement of said second hand correction member and thereby said second hand correction member when reciprocated will be biased in a direction opposite to that of rotation of said cam.

DESCRIPTION OF THE PREFERRED EMBODIMENTS

Figure 1:
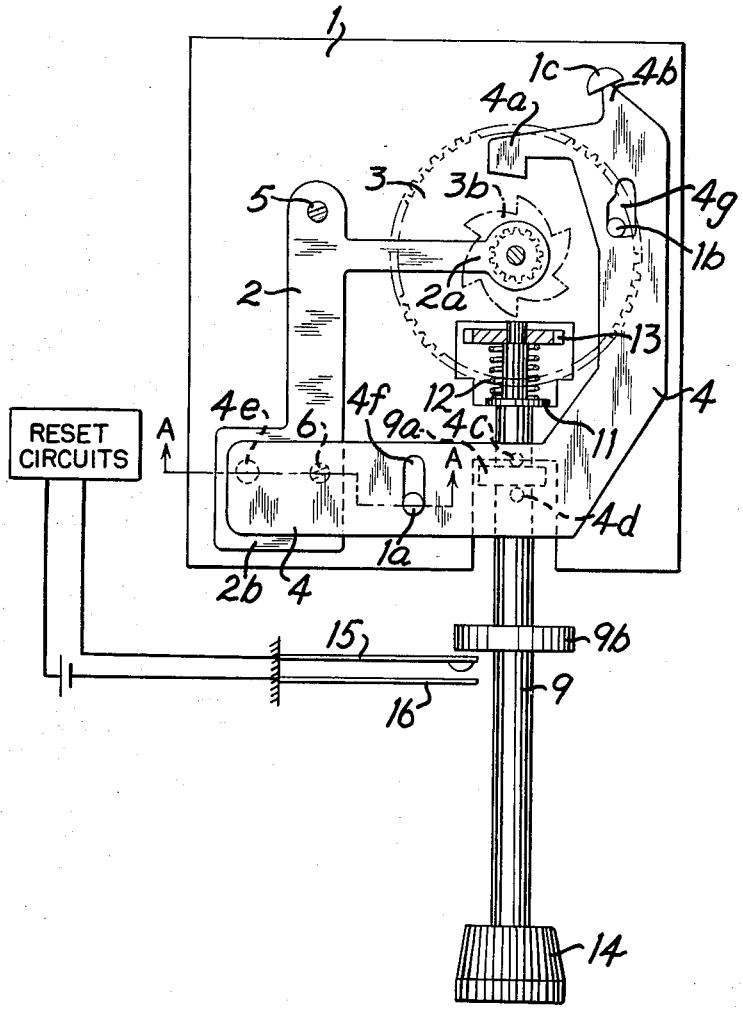
FIG. 1 is a top plan view of a first embodiment of the present invention.

Referring now to FIGS. 1 to 4, a structure of the first embodiment will be described hereinbelow.

Reference numeral 1 denotes an intermediate plate having pins 1*a* and 1*b* and semi-circular pin 1*c*. The pins hold a cover 10 fixed thereon. A second hand gear 3 driven by an electric-mechanical transducer or motor M has a pinion 3*a* and a cam wheel 3*b* integrally formed therewith and is fixed to a second hand axis 17. The second hand axis 17 is rotatably supported by the intermediate plate 1 and the cover 10 and has a second hand 18 at the leading end thereof. A minute hand gear 19 rotatably supported by the intermediate plate is driven via an intermediate gear (not shown) to be engaged with the second hand gear 3 and has a pinion 19*a* to be engaged with a series of well-known gears of a timepiece, and a gear 19*b* to be engaged with the intermediate gear. The upper part of the minute hand gear is integrally formed with a crown gear 19*c* to be described hereinbelow. Reference numeral 2 designates a frictional piece having a first arm 2*a* and another arm 2*b*. The frictional piece is fixed to the intermediate plate 1 by screws 5 and 6. The first arm 2*a* of the frictional piece is operated so as to push up the second hand gear 3 and to provide a specified slippage torque to the second hand gear 3 so that the second hand 18 may not be bound. A second hand correction lever 4 is supported by a first recess 4*f* engaged with the pin 1*a* of the intermediate plate and another recess 4*g* engaged with the pin 1*b* so that the lever may be moved in inward and outward directions. The second hand correction lever has a projection 4*b*, an operating cam 4*a*, a pin 4*e* and two pins 4*c* and 4*d*. That is, the pin 4*e* of the second hand correction lever is pressed against the arm 2*b* of the frictional piece and thereby the second hand correction lever 4 is applied with a specific frictional force at the left end thereof.

Figure 2:
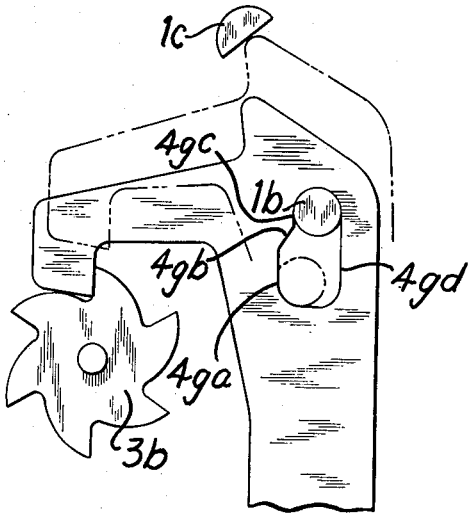
FIG. 2 is a top plan view showing the conditions after and before the second hand is corrected in reference to FIG. 1.
Figure 3:
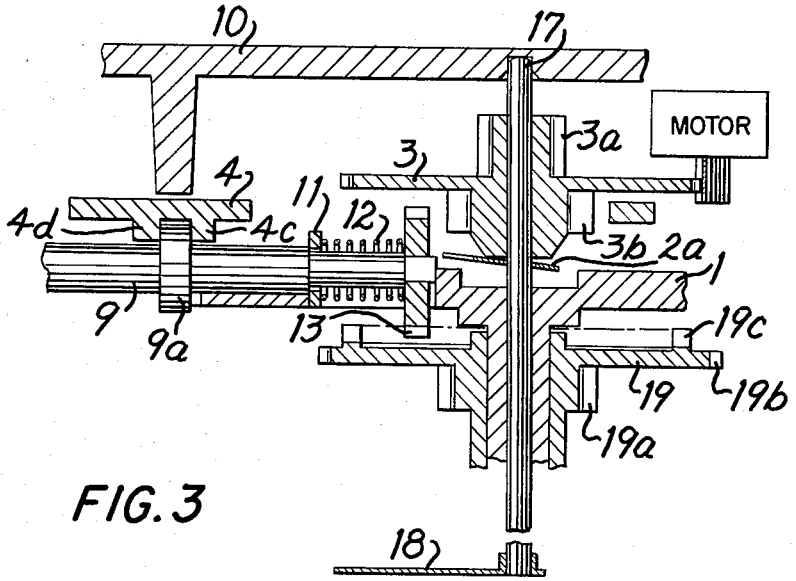
FIG. 3 is a sectional view of FIG. 1.

The recess 4*g* is formed with, as shown in FIG. 2, four edges (4*ga*, 4*gb*, 4*gc*, 4*gd*) having a wider lower end and a narrow upper end. Reference numeral 9 designates a hand operated rotary shaft having a knob 14 at the leading end thereof, and at the intermediate portion of the shaft are provided a first flange 9*a* and another flange 9*b*. The shaft has a hand driven rotary gear 13 at the leading end thereof. The hand rotary shaft 9 has a compression spring 12 between a movable washer 11 and the hand driven rotary gear 13. The hand rotary shaft 9 may be moved inwardly and outwardly due to provision of the recesses in the intermediate plate and is further rotatably supported. The first flange 9*a* is held by the two pins 4*c* and 4*d* of the second hand correction lever, and its inward and outward movement is transmitted to the second hand correction lever 4. When the second hand axis 9 is moved outwardly, the washer 11 is engaged with the intermediate plate 1, the compression spring 12 is compressed and the second hand rotary gear 13 is moved outwardly to be engaged with the crown gear 19*c* of the minute hand gear 19 at the lower end thereof. Reference numbers 15 and 16 are contact members to be operated in such a manner as the driving motor M is stopped when a normally-opened switch is closed.

In such a system described above, the operation thereof will be explained hereinbelow. When the knob 14 is pulled outwardly, the hand driven rotary gear 13 is engaged with the crown gear 19*c* of the minute hand gear at the terminal end thereof. Then when the knob 14 is rotated, the hand driven rotary gear 13 is rotated and this rotation is transmitted to the minute hand gear 19 via the crown gear 19*c*. Further, the rotation is transmitted to an hour hand gear via a gear not shown, so that it is possible to set the minute hand and hour hand mounted on each of the gears to a correct time. The rotation of the minute hand gear 19 is apt to be transmitted to the second hand gear 3 via said intermediate gear, but the intermediate gear is provided with a slip mechanism and this slip torque is set to be lower than a brake torque of the motor and thus it will be slipped by the slipping mechanism and then the rotation is not transmitted to the second hand gear 3.

Figure 4:
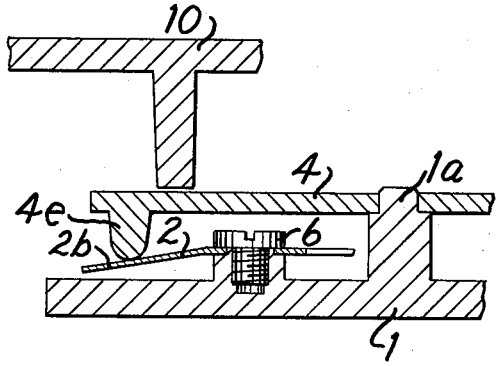
FIG. 4 is a sectional view taken along the section line A—A of FIG. 1.

A correction of the second hand will be described in reference to FIG. 1 wherein the second hand is set at the positions of 0, 10, 20, . . . 50 seconds. Under this condition, when the knob 14 is pulled outwardly against a force of the spring 12, the first flange 9*a* of the hand driven rotary axis is held by the pins 4*c* and 4*d* of the second hand correction lever, so that the second hand correction lever 4 is also started to be moved outwardly. At this time, since the pin 4*e* of the second hand correction lever always presses the arm 2*b* of the friction piece in a downward direction, as shown in FIG. 4, the second hand correction lever 4 is applied a rotational force in a clockwise direction about the pin 4*e* by the friction force. Thereby, the second hand correction lever 4 is biased in a clockwise direction and the recess edge $4_{ga}$ is lowered or moved while in contact with the pin 1*b*. In this way, as the lowering operation proceeds, the cam part 4*a* of the second hand correction lever contacts the cam wheel 3*b* of the second hand gear and starts to rotate the cam wheel in a counter-clockwise direction. And at the same time, when the succeeding lowering operation is performed, the edge of the recess $4_{gb}$ contacts the pin 1*b*, the second hand correction lever 4 is displaced in a counter clockwise direction and further descends to be stopped at a position shown by a solid line in FIG. 2. During this process, the cam wheel 3*b* of the second hand gear is rotated by the second hand correction lever 4 is displaced in a counter-clockwise direction by an amount just corresponding to one cam (10-second scale). The drawing illustrates the mechanism from its rear side and thus the second hand is advanced by a 10-second scale. On the other hand, when the flange 9*b* of said hand driven rotary axis contacts a first contact piece 15 by a downward or outward movement of the hand rotary axis 9 and the first contact piece is moved outward to contact the second contact piece 16, the reset circuits R and C are operated to stop the operation of the motor M. When the knob 14 is released after a predetermined time is passed, the hand operated rotary axis 9 is started to move inwardly by a spring force of the compression spring 12, the first contact piece 15 is released from a contacted condition with the second contact piece 16 and is restored to its original position by its spring force. Then, the reset circuits R and C are released and the motor M is started to operate and then the second hand is started to operate. On the other hand, the second hand correction lever 4 in cooperation with said hand operated rotary axis 9 is also raised or moved inwardly. At this time, since the second hand correction lever 4 is applied with a rotational force of a counter-clockwise direction, opposite to the direction of the frictional force developed during outward movement of the second hand correcting lever 4, by the frictional force of the arm 2*b* of the friction piece, then the right side face $4_{gd}$ of the recess of the second hand correction lever and the pin 1*b* of the intermediate plate are moved inwardly while they are in contact with each other and thereby engagement between the cam 4*a* of the second hand correction lever and the cam 3*b* of the second hand gear is disengaged or released. Thereafter, when further moved inwardly, the flange 4*b* of the second hand correction lever contacts the semi-circular pin 1*c* of the intermediate plate, slides along the inclined face thereof to forcibly displace the second hand correction lever 4 in a clockwise direction and further stops at such a position as the left side surface of said recess $4_{ga}$ is in contact with the pin 1*b*. Under this condition, even if the knob 14 is pulled at once, the cam 4*a* of the second hand correction lever is already prepared to be engaged with the next cam wheel 3*b*, thus it is possible to have a continuous operation of the second hand correction lever 4. In the above described operation, the 10-second advancement is performed while the second hand is set to a multiple of a unit of 10 seconds such as 0 second, 10 seconds, . . . . It is possible to provide successive 10-second advancements by advancing the second hand up to a position of multiple of a unit of 10 seconds by a first operation and further by continuous repetition of the second hand connection operation, even if the second hand is initially located at any position of the second scale.

Figure 5:
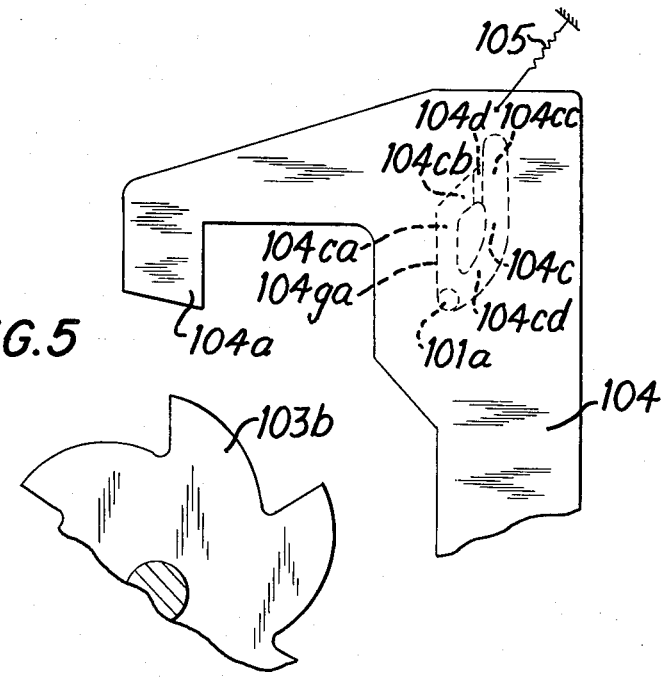
FIG. 5 is a top plan view of another embodiment of the present invention.

Referring now to FIG. 5, another embodiment of the present invention will be described hereinbelow. In the first embodiment, an operational orbit or path of the second hand correction lever when reciprocated is changed by a friction force of the leaf spring and to the contrary in the present embodiment, the object of changing the operational path is established by providing a substantial D-form recess for changing the operational path when the second hand correction lever is reciprocated.

The structure and operation of the second embodiment will be described hereinbelow. A second hand correction lever 104 is provided with a first recess 104*c* having two straight line portions $104_{ca}$ and $104_{cc}$ and two inclined portions $104_{cb}$ and $104_{cd}$ and with another recess $104_d$ having its depth to be set in slightly more shallow than that of said first recess 104. The first recess $104_c$ and another recess $104_d$ are engaged with the pin 101*a* mounted on the intermediate plate and the second hand correction lever 104 is applied with a clockwise and inward spring force by the spring 105. The above described structure is the same as that of the first embodiment and thus its description will be eliminated. When the operating member (e.g. the hand rotary knob) is pulled, the second hand correction lever 104 in cooperation with said operating member is also started to descend. At this time, the second hand correction lever 104 is biased by a spring force of the spring 105 in a clockwise direction and thus the left side surface $104_{ga}$ of the first straight line portion $104_{ca}$ of the first recess and the pin $101_a$ of the intermediate plate descend while they are contacted with each other. As the descending movement is continued, the cam portion $104_a$ of the second hand correction lever is contacted with the cam wheel 103*b* and starts to rotate the cam wheel in a counter-clockwise direction and at the same time when the subsequent descending operation is performed, the second hand correction lever 104 is displaced in a counter-clockwise direction by the first inclined portion $104_{cb}$ of the first recess and further descent is terminated after passing the recess 104*d*. During this process, the cam wheel 103*b* is rotated in a counter-clockwise direction by an amount corresponding to that of one cam. After a desired time has passed, the hand operated rotary knob is released and in the same manner as that of the first embodiment the second hand correction lever 104 starts to move inwardly. At this time, since the first recess 104*c* is deeper than the recess 104*d*, the second hand correction lever 104 is raised by the straight line portion $104_{cc}$ of the first recess. After the engagement between the cam portion 104*a* of the second hand correction lever and the cam wheel 103*b* is disengaged, the second hand correction lever 104 is rotated in a clockwise direction by the inclined portion $104_{cd}$ of the first recess and returned to a position shown in FIG. 5.

As described above, since there is provided such a recess which changes the path of the second hand correction lever when the lever is reciprocated, as in the first embodiment, it is possible to provide a continuous repetitive operation.

In the present embodiment, the second hand correction lever is operated in cooperation with the hand rotary axis for correcting the hour and minute hands. However, it is possible to provide a second hand correction button for use in correcting only the second hand, and to operate the second hand correction lever in cooperation therewith to get the same effect as that described above. And further it is possible to provide a second hand correction device having a high reliability by arranging a slip mechanism between the second hand gear and the cam wheel.

In accordance with the present invention, as described in detail, the cam wheel is fixed to the second hand axis, a continuous correction for the second hand may be provide by changing the orbit or path of movement when the second hand correction lever in cooperation with the manual operating member is reciprocated and it is more valuable in its practical use.

What we claimed is:

1. Second hand correction device in a timepiece having a second hand that regularly rotates in a particular direction, comprising, a second hand axis provided with a cam wheel fixed thereto and having a plurality of cams, a second hand correction member manually movable in a forward direction and a reverse direction and rotationally, control means for controlling the forward and reverse direction movements of said second hand correction member such that, during forward movement of said correction member, said correction member is first rotated in a direction opposite to the regular direction of rotation of said second hand axis by said control means, and then said second hand correction member is engaged with one of said cams of said cam wheel, and thereafter during further forward movement said correction member is displaced by said control means in the direction of regular rotation of said second hand axis so as to forcibly rotate said cam wheel as said second hand correction member continues to move so as to advance a position of the second hand by an amount determined by the one of said cams of said cam wheel with which said second hand correction member is engaged.

2. A second hand correction device according to claim 1, including an electromechanical transducer, switch means for turning said transducer on and off electrically, and means on said second hand correction member for controlling on and off conditions of said switch in dependence upon corresponding axial positions of said second hand correction member.

3. A second hand correction device according to claim 1, in which said control means comprises a friction plate having guide means with edges, pins engaging said edges limiting travel of said second hand correction member and guided on said edges to allow said forward and reverse movements of said second hand correction member.

4. A second hand correction member according to claim 3, in which said guide means comprises a through slot on said friction plate and into which said pins extend.

5. A second hand correction member according to claim 3, in which said guide means comprises a recess on said friction plate and into which said pins extend.

6. Second hand correction device in a timepiece having a second hand characterized in that there are provided a cam wheel fixed on a second hand axis and having a plurality of cams, the second hand and cam wheel having a regular direction of rotation, a manually operable member, control means and a second hand correction member driven by said manually operable member and controlled by said control means so that, when said correction member is driven, first said second hand correction member is rotated in a direction opposite to the regular rotation of said second hand by said control means so that said second hand correction member is engageable with a cam of said cam wheel, secondly said correction member is engaged with said cam of said cam wheel, and finally said second hand correction member is displaced to forcibly rotate said cam wheel in a direction for advancing said second hand by an amount determined by said cam of said cam wheel.

7. Second hand correction device as set forth in claim 2, characterized in that said second hand correction member comprises a recess, and said control means comprises a friction piece acting upon one end of said second hand correction member, the recess formed on said second correction member, and pins engageable with said recess for slidably and rotatively guiding said correction member.

* * * * *